United States Patent [19]

Petit et al.

[11] Patent Number: 4,728,063

[45] Date of Patent: Mar. 1, 1988

[54] RAILWAY SIGNALLING SYSTEM ESPECIALLY FOR BROKEN RAIL DETECTION

[75] Inventors: William A. Petit, Spencerport; John H. Auer, Jr., Fairport, both of N.Y.

[73] Assignee: General Signal Corp., Rochester, N.Y.

[21] Appl. No.: 894,223

[22] Filed: Aug. 7, 1986

[51] Int. Cl.[4] ..... B61L 21/06

[52] U.S. Cl. ..... 246/34 R; 246/34 CT; 246/37

[58] Field of Search ..... 246/34 R, 40, 34 CT, 246/34 C, 37, 120, 121, 28 F, 28 C

[56] References Cited

U.S. PATENT DOCUMENTS

| | | | |
|---|---|---|---|
| 1,710,499 | 4/1929 | Lewis . | |
| 2,880,307 | 3/1959 | Martin | 246/34 R |
| 2,975,272 | 3/1961 | Renick et al. | 246/34 R |
| 3,046,392 | 7/1962 | Luft . | |
| 3,359,416 | 12/1967 | Wilcox | 246/34 R |
| 3,529,150 | 9/1970 | Coupin . | |
| 3,794,833 | 2/1974 | Blazek . | |
| 3,875,525 | 4/1975 | Ballinger . | |
| 3,897,921 | 8/1975 | West . | |
| 3,906,349 | 9/1975 | Harrison . | |
| 3,974,991 | 8/1976 | Geiger . | |
| 3,987,989 | 10/1976 | Geiger . | |
| 4,022,408 | 10/1977 | Staples . | |
| 4,074,879 | 2/1978 | Clark . | |
| 4,117,529 | 9/1978 | Stark . | |
| 4,306,694 | 10/1981 | Kuhn . | |
| 4,314,306 | 2/1982 | Darrow . | |
| 4,314,374 | 2/1982 | Kuhn . | |
| 4,365,777 | 12/1982 | Geiger . | |
| 4,389,033 | 6/1983 | Hardman . | |

*Primary Examiner*—John W. Caldwell, Sr.
*Assistant Examiner*—Alvin Oberley
*Attorney, Agent, or Firm*—M. LuKacher; R. Reichman

[57] ABSTRACT

Broken rail detection in a block of track without the need or expense of conventional signalling uses a chain of transmitters and receivers connected to the rails and defining sections of the block between the ends of the block. Either cyclically at a predetermined code rate or upon command of an external unit; an alternating current (AC) signal is launched from one end of the block and is repeated at different frequencies in each of the sections. When received at the end of the block, an indication of the absence of a broken rail condition is given either (a) by way of pole line or radio communication to a central control or dispatcher point and thence back to the trains, or (b) signals at the ends of the block are flashed at the code rate. The detected signal at the code rate may be used to modulate a direct current which is transmitted along the rails in the block to a signal at the opposite end of the block which also flashes at the code rate to indicate a safe condition. When it is desired to allow more than one train into a block, a signal may be launched after the first train has entered the block. A second train may then enter the block at restricted speed. When the first train exits the block, the previously launched signal arrives at the receiving end providing an indication that the rail is intact in front of the second train.

8 Claims, 5 Drawing Figures

RAILWAY SIGNALLING SYSTEM ESPECIALLY FOR BROKEN RAIL DETECTION

DESCRIPTION

The present invention relates to railway signalling systems, and particularly to a railway signalling system which provides broken rail detection. The broken rail detection can be provided over long lengths of track, which may extend several miles.

The invention is especially suitable for providing broken rail detection in existing railroad territories which are not provided with signalling systems such as pole line and track circuits, and affords an inexpensive means of providing protection against broken rails without the expense of the conventional signalling or track circuits, and if desired, without radio based (either satellite or terrestrial radio) signalling.

Conventional track circuits provide a degree of broken rail detection capability. Such track circuits can use alternating current signals or direct current signals which are detected and operate wayside signals or signals in the engine cab. Direct current track circuits require the use of repeaters to extend over long distances, with each repeater requiring a power source and a pair of insulated joints. Alternating current track circuits also require the use of powered repeaters and at more frequent intervals than DC track circuits. Alternating current track circuits used for train detection are also not very effective for broken rail detection.

A problem in broken rail detection is that under certain environmental conditions, such as wet ballast, continuity will be provided through the ballast bridging a rail break. In order to provide reliable broken rail detection capability, the sections of the rail which are checked for continuity, and the absence of a broken rail condition, should be short enough so that the signal transmitted even through the wet ballast around the break will be attenuated sufficiently more than the signal through the unbroken rails so as to enable detection of a broken rail condition under all environmental conditions of interest. To provide a broken rail detection system capable of detecting broken rail conditions over long track lengths with sufficiently short sections and within reasonable costs constraints is accomplished in accordance with a feature of this invention.

It is a principal object of the present invention to provide an improved railway signalling system which provides broken rail detection capability over long track lengths.

It is a further object of the present invention to provide a railway signalling system which detects broken rail conditions over a block of track which may be of great length, say several miles, and which also can be used to provide an indication of track occupancy in the block.

It is another object of the present invention to provide an improved broken rail detection system which utilizes repeaters (receivers and transmitters) operating at different frequencies to provide short sections over which broken rails can be detected with reliability under difficult environmental conditions, such as wet ballast.

It is still another object of the present invention to provide an improved broken rail detection system which utilizes alternating current repeaters in successive track sections which are operated with direct current power transmitted along the rails.

It is a still further object of the present invention to provide an improved broken rail detection system operative over long track lengths without insulated joints except at the ends of the block wherein broken rail conditions are to be detected.

It is a still further object of the present invention to provide an improved broken rail detection system using alternating current repeaters to isolate sections of the track in a long block wherein broken rail conditions are detected.

It is a still further object of the present invention to provide an improved broken rail detection system wherein signals need only be transmitted one way from one end of the block to the other to provide for signals indicating the presence or absence of broken rail conditions at both of the opposite ends of the block.

It is a still further object of the present invention to provide an improved broken rail detection system for detecting broken rail conditions over long track lengths which is vital in operation without the need for complex or expensive equipment to provide such vital (fail-safe) operation.

It is a still further object of the present invention to provide an improved broken rail detection system utilizing a daisy chain of repeaters located at successive sections along a block of track and which provides for multi-frequency operation (each section having a transmitter operated at a different frequency) so as to provide for isolated sections.

It is a still further object of the present invention to provide an improved broken rail detection system utilizing a multi-frequency, daisy chain of repeaters so as to provide a sufficient number of sections along a block of track to provide for reliable operation over long distances wherein direct current is supplied to the track both for powering the repeaters and as a communications link between opposite ends of the block.

It is a still further object of the present invention to provide an improved broken rail detection system which can be operated to allow a preceding train and a following train into the block which is provided with the system so as to check for rail breaks between the trains and provide information on a broken rail condition when the leading train moves out of the block thereby enabling the following train to enter the block at restricted speed and to remove the restriction when the leading train leaves the block.

Briefly described, a railway signalling system embodying the invention detects a broken rail condition in a block of track which is insulated from adjacent portions of the track only at the ends of the block. The system utilizes means connected to successive sections of the track for transmitting and receiving alternating current signals of different frequencies along the rails in a plurality of successive sections of the block. The transmitting and receiving means includes a plurality of repeaters connected to the ones of the sections which are disposed between the sections of the track at the ends of the block for repeating the signals received from their preceding section at a different frequency from the frequency of the signal transmitted along the rails in said preceding sections. The system also utilizes means connected to the receiving means which is connected to the section at the end of the block and which is responsive to the absence of a received signal for signalling a condition representing a broken rail.

The foregoing and other objects, features and advantages of the invention, as well as presently preferred embodiments thereof, will become more apparent from the reading of the following description in connection with the accompanying drawings in which:

FIGS. 2 and 2A are block diagrams illustrating a broken rail detection system in accordance with other embodiments of the invention;

Figure 1:
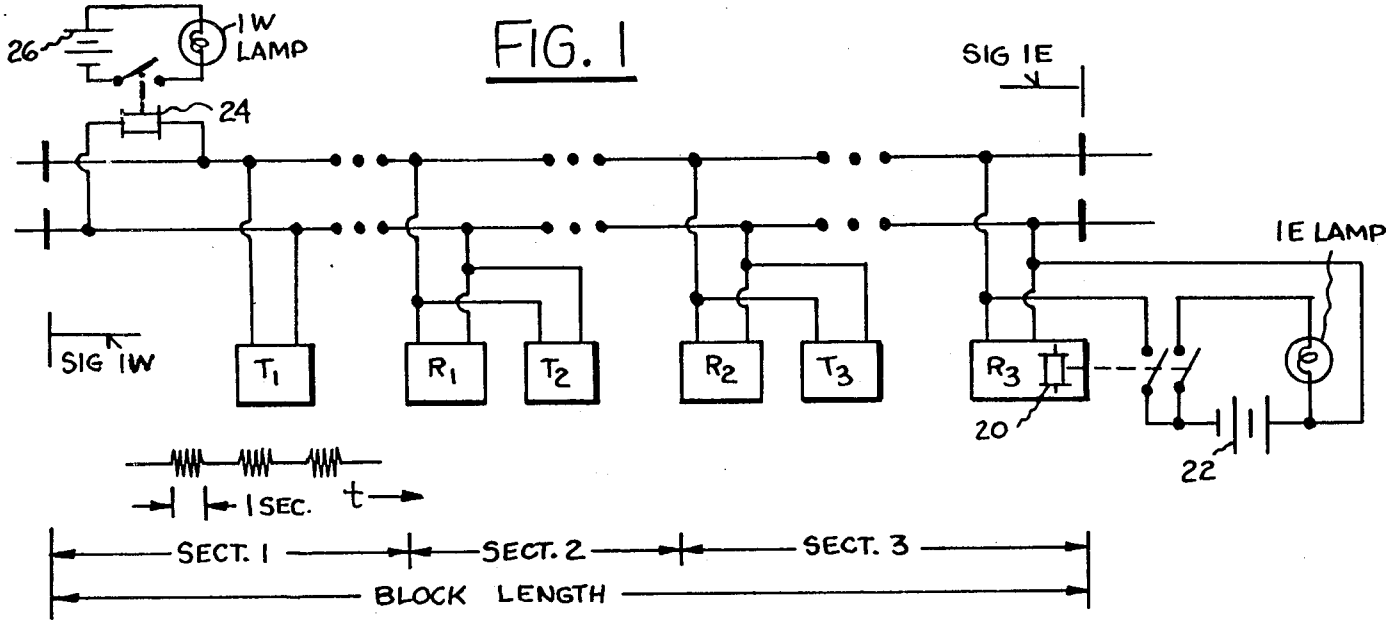
FIG. 1 is a schematic diagram illustrating a broken rail detection system in accordance with an embodiment of the invention.

Referring more particularly to FIG. 1, there is shown a railway signalling system in which the rails may be utilized as a communications link and which provides fail-safe (vital) broken rail detection capability. There is shown a block of track having three sections. The rails of the block are continuous. Insulated joints are shown provided at the opposite ends of the block only. There are three sections illustrated for convenience. It will be appreciated that many more sections will normally be provided in the block, each section being sufficiently short so that the attenuation through the ballast will be less than the attenuation through continuous rail in the section. In a typical railway application the sections may be a mile apart. The sections are defined between audio-frequency, AC transmitters $T_1$, $T_2$, $T_3$ and receivers $R_1$, $R_2$, $R_3$ in adjacent sections. Each transmitter operates a different frequency. Frequencies may be repeated when separated by sufficient distances. Thus by "different frequencies" is meant like frequencies when beyond effective propogation distances along the track. Frequencies in adjacent sections may differ by a few hundred cycles or at least enough to be selectively detected by the filters in the receivers. The receiver-transmitter units $R_1T_2$ and $R_2T_3$ in the intermediate sections are repeaters.

There are wayside signals at the entrances of the block at the opposite ends of the block. These signals are indicated as SIG 1W and SIG 1E. The receiver unit at the easterly end of the block which contains the receiver $R_3$ also contains a relay 20 having two contacts. One of these contacts is connected with a DC source indicated as a battery 22 across the rails. The other contact is connected in series with the battery and a lamp, indicated as the 1E lamp of the signal 1E. There is another relay 24 which is connected across the rails at the westerly end of the block. The contact of this relay is connected in series with a voltage source, indicated as a battery 26 and the 1W lamp of the westerly signal SIG 1W. The transmitter $T_1$ is operated cyclically to produce bursts of audio-frequency signals at the frequency of operation of the transmitter $T_1$. The code rate is one second on and one second off in this illustrated embodiment of the invention. All of the operating power for the transmitters and receivers comes from the DC source 22. However, power for $T_1$ may come from DC source 26. The transmitters in the intermediate section are operated only when the receiver of their repeater unit detects an alternating current audio-frequency from the transmitter of its preceding unit. Then the transmitter is turned on. Accordingly, each of the transmitters $T_2$ and $T_3$ will transmit the bursts of audio-frequency current in a daisy-chain fashion along the rails in the block. Power for the receivers and transmitters may be obtained from the DC current transmitted through the rails from the DC source 22.

The transmitter $T_1$ transmits an amplitude modulated audio-frequency, the modulation being the bursts at the code rate as shown in the waveform diagram adjacent to the transmitter $T_1$. The receiver $R_1$ receives this frequency and causes the transmitter $T_2$ of its repeater unit to transmit a second audio-frequency in synchronism with the signal from the transmitter $T_1$ and at the code rate. Of course, in the presence of a broken rail condition, the audio-frequency code rate signal is not repeated. This audio-frequency code rate is also repeated by the second repeater unit including the receiver $R_2$ and $T_3$, each of which operate at a different frequency. As discussed above, frequencies may be reused when the transmitters are separated by sufficient distances. The code rate is received by the receiver $R_3$ at the easterly end of the block. The code rate signal received by $R_3$ is used to modulate the DC power source which is supplied to the rails utilizing the relay 20. The relay 20 follows the code rate. It opens for one second and closes for one second thereby providing a modulated DC.

This modulated DC is used both to drive the 1E lamp of the SIG 1E signal and is also applied to the rails. The rails provide a communication link which also provides power to all of the transmitters and receivers. The modulated DC is also used to energize the relay 24 which operates the SIG 1W lamp. The relay 24 then causes the lamp at the 1W signal to flash on and off in the presence of a safe, nonbroken rail condition. The system shown in FIG. 1 has the following advantages. A broken rail condition anywhere within the block is detected, since the audio-frequency signal will not be passed along the daisy chain of repeater units and will not permit the wayside signals to flash. Any failure conditions will cause either the wayside signals to be dark or to be illuminated (on) steady or continuously. Accordingly, dark or steady-on indications will be considered restrictive, since the signals must be flashing for an indication that the track ahead is intact. The audio-frequency circuits can also be designed so that the signals will also not flash if any of the sections are occupied. While broken rail detection is the principal feature of this system, it may also be used to provide signals indicating track occupancy in the block.

The audio-frequency repeaters enable the total block length to be lengthened, since the sections can be set at the required length for worst-case ballast conditions. The use of audio-frequency transceivers with multiple frequencies enables the rails to be continuous (without insulated joints except at the control points at the block ends). The audio-frequency repeaters are passive and no wayside power or batteries are needed for their operation. The long DC communications link between the control points (in this case the wayside signals) at the opposite ends of the block are not sensitive to ballast conditions (other than requiring some minimum received voltage in order to be detected), since the DC communications link is not used for train detection or broken rail detection.

Figure 2:
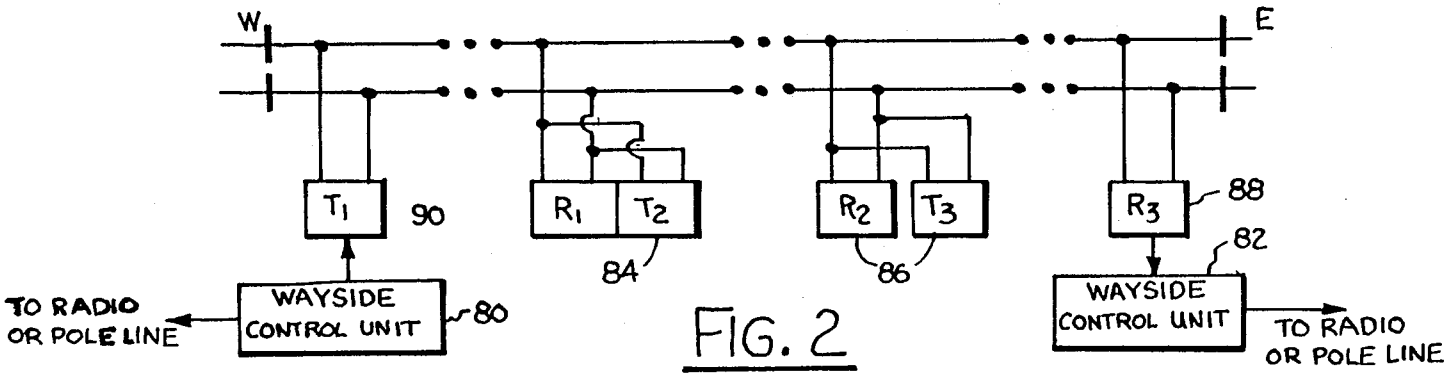

Referring to FIG. 2, there is shown a broken rail system where communication is provided between the control points at the opposite ends of the block through a radio link (or pole lines), as may be provided by the illustrated wayside radios and control units 80 and 82 or by pole lines. Transceiver units 84, 86, 88 and 90 define the ends of each of the sections. Signalling for broken rail detection is also by multiple frequency, audio-frequency current through the rails, as was the case in the system illustrated in FIG. 1. The transmitters are operated only on demand, rather than continuously or in repeated cycles. When a train approaches an end of the block and it is desired to verify that the track is intact, the dispatcher sends a command to the control point which causes multiple frequency signals to be transmitted in a daisy-chain manner along the sections of the block between the repeater units 90 to 88. At the control point the wayside radio 82 reports back to the central office that the rail is intact or is broken. This communication may be made vital through the use of vital communication controls on the radio link or other communication lines. A radio-based communication system which may be used for communicating to the central office and thence back to the trains is the subject of an application filed by the inventors hereof, U.S. Ser. No. 849,614, on Apr. 8, 1986, U.S. Pat. No. 4,711,418 and entitled Radio Based Railway Signaling and Traffic Control System.

The advantage of the system shown in FIG. 2 is that the need for wayside signals and DC power transmission through the rails is eliminated. Battery power for the audio-frequency transmitters and receivers may be used since they are only operated on an as-needed basis. For low traffic lines this may only be a few minutes per day.

The system illustrated in FIG. 2A may be operated for areas having heavier traffic density to enable a second or following train to enter the block before the lead or first train clears the block. In accordance with this feature of the invention the transmitted audio-frequency at the entry of the block (via the frequency of the transmitter $T_1$ in the repeater 34) is maintained on as is the signal from each succeeding transmitter until confirmation is received that the receiver of the next repeater unit has received the signal. Thus the signal is trapped between the leading and following trains and still propagates to the opposite end of the block as soon as the leading train clears the block. The following train can then be permitted to move into the block at a reduced speed aspect. When the leading train clears the block, the speed aspect can be raised and allow the following train to move at a higher permitted speed. Of course, the following train will be ordered to continue at a restrictive speed if a broken rail detection condition is sensed.

Although only two intermediate repeaters 36 and 38 are illustrated in FIG. 2A, it will be appreciated that many more may be used in a typical system. The block which is protected by the chain of repeaters may be disposed between two interlocks (with sidings), and the broken rail detection system provides continuous coverage between the two interlockings. The radio and control equipment 30 and 32 at the ends of the block are provided with duplex communications equipment, of the type described in the above-referenced application, U.S. Ser. No. 849,614. The unit 32 receives a message from the central office and then initiates a "launch" for broken rail detection. If the audio-frequency signal is received at the repeater 40 at the opposite end of the block, a signal received output operates the radio unit 32 so that the central office is informed that the rails are intact in the block. The system typically will be programmed to make a track integrity check just prior to the passage of each train through the block and at reasonable intervals to allow maintenance to be performed if a break is detected. The sections of the block are defined between the repeater units. The repeaters at the opposite ends of the block contain transmitters and receivers and control logic. There are two receivers and one transmitter in addition to control logic in the intermediate repeaters.

In operation, after a launch command is transmitted, the control logic in the repeater 34 enables transmitter $T_1$ to output an audio-frequency signal of frequency $F_1$. This signal is received by receiver $R_1$ of the first intermediate repeater 36 and enables the transmitter $T_2$ to output a signal of frequency $F_2$. The receiver $R_2$ of the first repeater 34 picks up the $F_2$ signal which is transmitted in both directions along the track. The control unit of the first repeater 34 responds to the received $F_2$ signal and turns the transmitter $T_1$ off. The receiver $R_2$ of the next repeater 38 also receives the $F_2$ signal and turns on its transmitter $T_3$. When the receiver $R_3$ of the repeater 36 receives the frequency $F_3$ from the transmitter $T_3$, it operates the control logic of the repeater 36 to turn the transmitter $T_2$ thereof off. Similarly, the easterly end repeater 40 has a receiver $R_3$ which detects the frequency $T_3$ and turns its transmitter $T_4$ on through the control logic thereof. When the signal of frequency $F_4$ is detected by the receiver $R_4$ of the repeater 38, the transmitter 33 is operated via the control logic of the repeater 38 to turn the transmitter $T_3$ off. There is therefore a chain reaction from one repeater to the next. The receiver circuits are always powered on and use very little energy. The transmitters are only used when necessary to conserve energy.

When the westerly repeater 40 receiver $R_3$ receives the $F_3$ signal, it operates the control logic thereof to provide a signal received output to the wayside radio and control unit 32 whence it is transmitted to the central office. The central office dispatcher communicates with the trains and controls traffic in accordance with the information as to whether the rail in the block is intact and/or has train occupancy.

Figure 3:
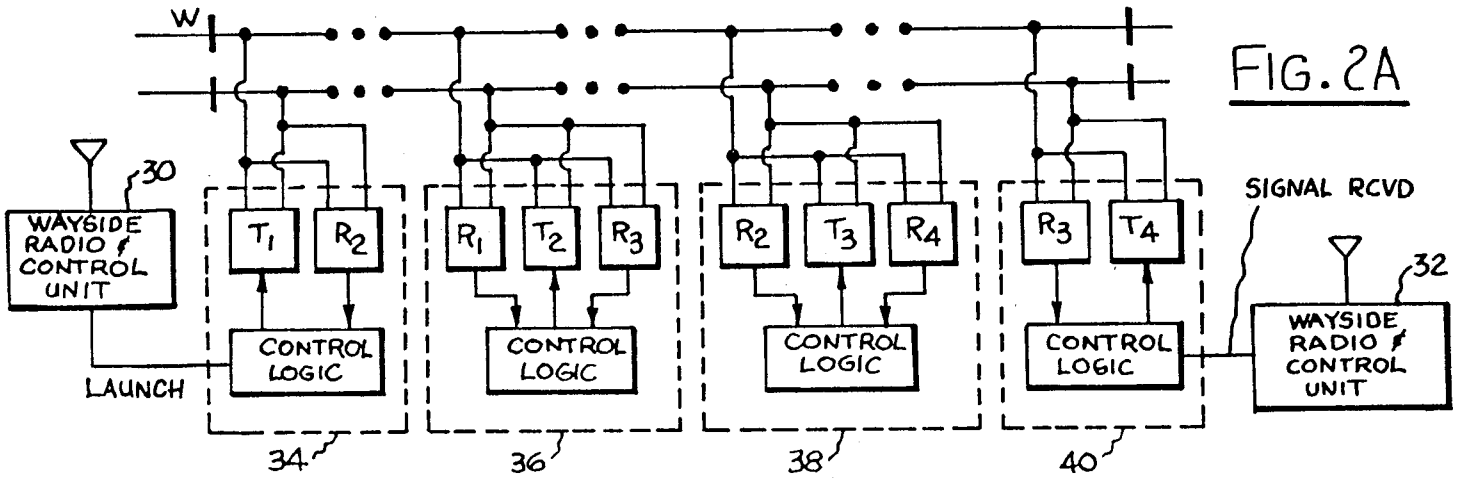
FIG. 3 is a block diagram illustrating a terminal unit of the system illustrated in FIG. 2A which is located at the ends of the block of track.
Figure 3:
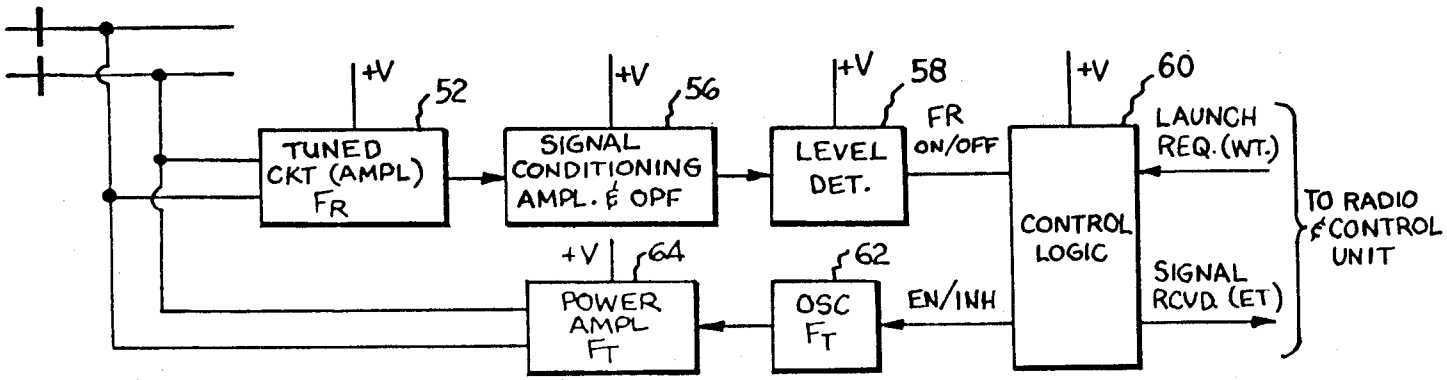

A typical westerly or easterly repeater unit, such as the 34 or 40 shown in FIG. 2A, is illustrated in FIG. 3. These repeaters may be powered either by primary battery or by DC current received from the rails. The receiver of the repeater includes a tuned circuit connected across the rails near the joints. The receiver is tuned to the frequency which is to be detected from the adjacent transmitter ($R_2$ in case of the westerly repeater 34 and $R_3$ in case of the easterly repeater 40). This frequency is indicated generally as $F_R$. The tuned circuit may be an active circuit with an amplifier and provides an output to a signal conditioning amplifier which may include a band pass filter 56. The signal conditioning amplifier 56 may provide an alternating current signal to a level detector 58, or the signal from the tuned circuit may be rectified and a DC level applied to the level detector 58. When the threshold level indicative of continuity to the rails and not merely transmission through the ballast is received, an output indicating that the received frequency is on ($F_R$ on/off) is provided to the control logic 60.

The control logic is also connected to provide an enable or inhibit output to an oscillator 62 which generates the frequency to be transmitted $F_T$. This oscillator signal is amplified in a power amplifier 64 tuned to $F_T$ and applied to the rails.

The control logic 60 may be hardwired logic or microcomputer implemented logic which implements the digital equations set forth below. For the west terminal repeater 34 the equations are as follows: If the launch request is on, then $T_1$ is on and launch request accepted is acknowledged to the control office via the wayside radio. If $F_R$ is on and $T_1$ is on, then the enable input to the oscillator 62 is turned into an inhibit input so that $T_1$ is turned off. For the east terminal the equations are: If $R_3$ is on then $T_4$ is turned on and the signal received output is on. If the signal received output is on and $R_3$ is off then $T_4$ is turned off and the signal received output is turned off.

A typical operation starting at an initial state and $F_R$ is off and EN/INH is in its off or inhibit state, is as follows: When the launch request is on the west terminal 34 transmitter $T_1$ is enabled to output the $F_1$ audio-frequency. This signal is received by the first repeater 36 and its transmitter $T_2$ outputs and audio-frequency $F_2$. Then the receiver $R_2$ of repeater 34 provides an $F_R$ on output due to the receipt of frequency $F_2$ causing $T_1$ to turn off.

The receiver located at the east terminal 40 operates as follows: When it receives an audio signal of frequency $F_3$, its transmitter $T_4$ turns on and the signal received message is conveyed to the radio 32 and thence to the central office. When the receiver $R_4$ of the preceding repeater 38 receives the $F_4$ signal, its control logic causes the transmitter $T_3$ to be turned off. When $F_3$ is no longer received by 40, $T_4$ is turned off.

Figure 4:
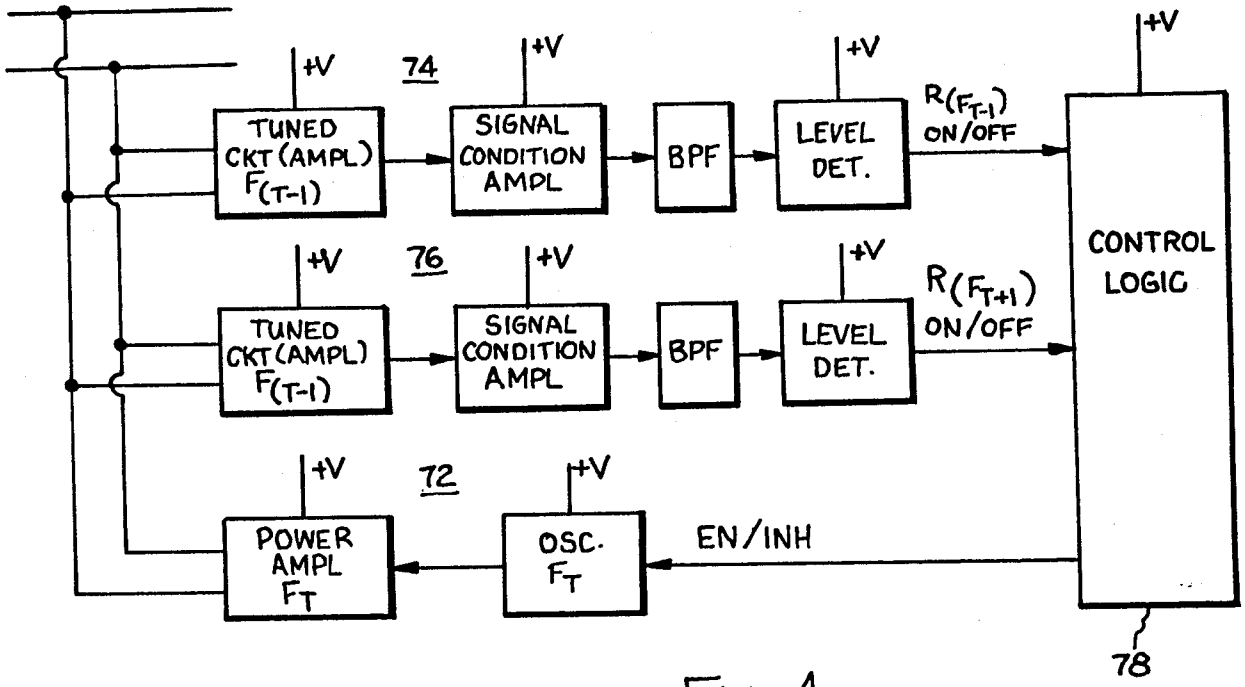
FIG. 4 is a block diagram illustrating a repeater unit which may be used in the intermediate sections of the block in the system illustrated in FIG. 2A.

Referring to FIG. 4 it will be noted that the design of the intermediate section repeaters 36 and 38 (FIG. 2A) is very similar to that of the easterly and westerly terminal repeaters. The operating power comes from either a local primary battery or from DC current in the rails. The transmitter channel 72 is similar to the transmitter channel consisting of the oscillator 62 and power amplifier 64 shown in FIG. 3. There are two receiver channels 74 and 76. Each consists of a tuned circuit amplifier, signal conditioning amplifier, band pass filter and level detector. The level detector outputs binary levels indicated as $R(_{FT-1})$ on/off and $R(_{FT+1})$ on/off to the control logic 78. The control logic implements the following Boolean equations either with hardwired logic or under program microprocessor control: if $R(_{FT-1})$ is on then $F_T$ is on; and if $R(_{FT+1})$ is on and $R(_{FT-1})$ is off then $F_T$ is off. The operation of the repeaters shown in FIGS. 1 and 2 will be apparent from the description of FIG. 3.

From the foregoing description, it will be apparent that there has been provided an improved railway signalling system for broken rail detection. Variations and modifications in the herein described system will undoubtedly suggest themselves to those skilled in the art.

We claim:

1. A railway signalling system which detects a broken rail in a block of track which is insulated from adjacent portions of track only at the ends of the block, said system comprising means for transmitting and also means for receiving alternating current signals of different frequency along the rails in a plurality of successive sections of said block, said sections being end sections at the opposite ends of said block and a plurality of intermediate sections between the end sections, said transmitting and receiving means including a plurality of repeaters having receivers and transmitters and being connected to said intermediate sections, each of said repeaters having its receiver tuned at a frequency different from any other of the receivers of any other of said repeaters and having its transmitter tuned to a frequency different from any other of the transmitters of said repeaters said receivers connected to said intermediate section, and the receiving means connected to the rails at one of the end sections being tuned to the frequency of the transmitter of the preceeding section for enabling the transmitter of a succeeding section in response to a signal received from a preceeding section to repeat the received signal at a different frequency from the frequency of the signal transmitted along the rails from their preceding sections, and means connected to the receiving means which is connected to one of the end sections and responsive to the absence of a received signal from said transmitting means of the section which precedes said one end section for signalling a condition representing a broken rail in said block.

2. A railway signalling system which detects a broken rail in a block of track which is insulated from adjacent portions of track only at the ends of the block, said system comprising means for transmitting and also means for receiving alternating current signals of different frequency along the rails in a plurality of successive sections of said block, said sections being end sections at the opposite ends of said block and intermediate sections between said end sections, said transmitting and receiving means including a plurality of repeaters connected to said intermediate sections for repeating the signals received from their preceding sections at a different frequency from the frequency of the signal transmitted along the rails from their preceding sections, and means connected to the receiving means which is connected to one of the end sections and responsive to the absence of a received signal from the transmitting means of the section which precedes said one end section for signalling a condition representing a broken rail in said block, and wherein the end section at the end of said block opposite to said one end section has connected thereto means for transmitting an AC signal at one of said different frequencies repetitively in bursts of certain duration, said signalling means including signalling devices having lamps disposed at the opposite ends of said block, means responsive to the receiving means at said one end section for providing a modulated DC current for flashing the lamp at the one of said signalling devices at said one end of said block, means for providing said modulated current to said rails, and means connected to said rails at the opposite end of said block for flashing the lamp of the signalling device at the opposite end of said block whereby the lamp indicates the rail condition.

3. The system according to claim 2 wherein means are provided connected to said rails for powering said means for transmitting and receiving said AC signal with energy derived from said modulated DC current.

4. The system according to claim 1 wherein said receiving and transmitting means includes a receiver connected to the rails of said track in said one end section. a transmitter connected to the rails at the end section at the opposite end of said block from said one end section, said repeaters being connected to said rails in the sections of said track intermediate said end sections.

5. A railway signalling system which detects a broken rail in a block of track which is insulated from adjacent portions of track only at the ends of the block, said system comprising means for transmitting and also means for receiving alternating current signals of different frequency along the rails in a plurality of successive sections of said block, said sections being end sections at the opposite ends of said block and intermediate sections between said end sections, said transmitting and receiving means including a plurality of repeaters connected to said intermediate sections for repeating the signals received from their preceding sections at a different frequency from the frequency of the signal transmitted along the rails from their preceding sections, and means connected to the receiving means which is connected to one of the end sections and responsive to the absence of a received signal from the transmitting means of the section which precedes said one end section for signalling a condition representing a broken rail in said block, and wherein the end sections are a respective first and last section of said sections of said block and a transmitter and a pair of receivers connected to the rails in each of said intermediate sections, one of said pair of receivers in each of said intermediate sections being tuned to the frequency of the AC signal transmitted by the transmitter of its preceding section, the other of said pair of receivers of said intermediate sections and the receiver of said first section being tuned to the frequency of the transmitter of its succeeding section, and separate control means connected to the transmitters and receivers in each of said sections for enabling the transmitter of a succeeding section in response to a signal received from a preceding section and inhibiting the transmitter of a preceding section in response to a signal received from a succeeding section.

6. The system according to claim 5 further comprising means connected to the control means of the receiver and transmitter of the first of said sections for operating said control means thereof to enable the transmitter of said first section and thereby launch a transmission of said AC signals along the rails of said block, and means operated by the receiving means of the last of said sections for signalling the detection or non-detection of a broken rail and track occupancy condition.

7. The system according to claim 6 further comprising radio controlled means for operating said signal launching means, and radio means responsive to said means for signalling the detection of said condition.

8. The system according to claim 6 further comprising means for supplying DC current to the rails in said block, means connected to said rails for applying operating voltage to all of said transmitters and receivers with energy supplied from said DC current.

* * * * *